US005904839A

United States Patent [19]

Brons

[11] Patent Number: 5,904,839

[45] Date of Patent: May 18, 1999

[54] PROCESS FOR UPGRADING HEAVY OIL USING LIME

[75] Inventor: Glen Barry Brons, Phillipsburg, N.J.

[73] Assignee: Exxon Research and Engineering Co., Florham Park, N.J.

[21] Appl. No.: 09/049,357

[22] Filed: Mar. 27, 1998

Related U.S. Application Data

[63] Continuation-in-part of application No. 08/870,990, Jun. 6, 1997.

[51] Int. Cl.[6] ..... C10G 29/00

[52] U.S. Cl. ..... 208/226; 208/27; 208/230; 208/208; 208/258; 208/259

[58] Field of Search ..... 208/226, 27, 230

[56] References Cited

U.S. PATENT DOCUMENTS

| | | | |
|---|---|---|---|
| 2,795,532 | 6/1957 | Honeycutt | 196/36 |
| 3,164,545 | 1/1965 | Mattox | 208/230 |
| 3,440,164 | 4/1969 | Aldridge | 208/218 |
| 3,449,242 | 6/1969 | Mattox et al. | 208/227 |
| 4,003,823 | 1/1977 | Baird, Jr. et al. | 208/108 |
| 4,007,109 | 2/1977 | Baird, Jr. et al. | 208/108 |
| 4,033,860 | 7/1977 | Carlson | 208/206 |
| 4,087,348 | 5/1978 | Baird, Jr. et al. | 208/108 |
| 4,127,470 | 11/1978 | Baird, Jr. et al. | 208/58 |
| 4,163,043 | 7/1979 | Dezael et al. | 423/234 |
| 4,199,440 | 4/1980 | Verachtert | 208/230 |
| 4,310,049 | 1/1982 | Kalvinskas et al. | 166/267 |
| 4,437,980 | 3/1984 | Heredy et al. | 208/235 |
| 4,566,965 | 1/1986 | Olmstead | 208/11 R |

FOREIGN PATENT DOCUMENTS

| | | | |
|---|---|---|---|
| WO97/08270 | 3/1997 | WIPO | C10G 19/00 |
| WO97/08271 | 3/1997 | WIPO | C10G 19/00 |
| WO97/08275 | 3/1997 | WIPO | C10G 71/00 |

OTHER PUBLICATIONS

Kalichevsky and Kobe, *Petroleum Refining With Chemicals*, Ch. 4, Elsevier Publishing (1956).

LaCount, et al, "Oxidation of Dibenzothiophene and Reaction of Dibenzothiophene . . . ", J. Org. Chem., vol. 42, No. 16, pp. 2751–2754 (1977).

Burger, et al, "Symposium on Progress in Processing Synthetic Crudes and Resids", Atlantic Richfield Company, pp. 765–775 (8/24–29/95).

*Primary Examiner*—Helane Myers
*Attorney, Agent, or Firm*—Linda M. Scuorzo

[57] ABSTRACT

The present invention relates to a continuous in-situ process for reducing the viscosity, corrosivity and density of heavy oils comprising the steps of (a) contacting a heavy oil with an anhydrous alkaline earth, Group IIA metal hydroxide and low pressure hydrogen at a temperature of about 380° C. to about 450° C. for a time sufficient to form the corresponding alkaline earth metal sulfide, recovering the reduced sulfur feed and regenerating the alkaline metal hydroxide for recycle to treat additional feed. Beneficially, the process removes heteroatoms (sulfur and nitrogen).

9 Claims, No Drawings

PROCESS FOR UPGRADING HEAVY OIL USING LIME

This application is a Continuation-In-Part of U.S. Ser. No. 08/870,990 filed Jun. 6, 1997.

FIELD OF THE INVENTION

The present invention relates to a process for upgrading heavy oils, bitumen, tar sands, and other residuum feeds.

BACKGROUND OF THE INVENTION

The quality of residuum feeds, particularly heavy oils, suffers from high levels of heteroatoms (nitrogen and sulfur). Such feeds are also high in naphthenic acid contents (measured by Total Acid Number—TAN) which presents corrosion problems in handling (e.g., refineries). These are highly viscous crudes that also possess relatively high densities or low API gravities. Transporting such heavy oils typically requires the blending with costly diluent which reduces the viscosity for pipelining.

Much work has been done utilizing molten caustic to desulfurize coals. For example, see "Molten Hydroxide Coal Desulfurization Using Model Systems", Utz, Friedman and Soboczenski, 51-17 (Fossil Fuels, Derivatives, and Related Products, ACS Symp. Serv., 319 (Fossil Fuels Util.), 51–62, 1986 CA 105(24):211446Z); "An Overview of the Chemistry of the Molten-caustic Leaching Process", Gala, Hemant, Srivastava, Rhee, Kee, Hucko, and Richard, 51-6 (Fossil Fuels, Derivatives and Related Products, Coal Prep. (Gordon and Breach), 71-1-2, 1–28, 1989 CA 112 (2):9527r; and Base-catalyzed Desulfurization and Heteroatom Elimination from Coal-model Heteroatomatic Compounds", 51-17 (Fossil Fuels, Derivatives, and Related Products, Coal Sci. Technol., 11 (Int. Conf Coal Sci., 1987), 435-8, CA 108(18):153295y).

Additionally, work has been done utilizing aqueous caustic to desulfurize carbonaceous material. U.S. Pat. No. 4,437,980 discusses desulfurizating, deasphalting and demetallating carbonaceous material in the presence of molten potassium hydroxide, hydrogen and water at temperature of about 350° C. to about 550° C. U.S. Pat. No. 4,566,965 discloses a method for removal of nitrogen and sulfur from oil shale with a basic solution comprised of one or more hydroxides of the alkali metals and alkaline earth metals at temperatures ranging from about 50° C. to about 350° C. U.S. Pat. No. 4,127,470 requires a high pressure (500 psi, 2,070 kPa to 5000 psi, 20,700 kPa) hydrogen, high temperature (500° F., 260° C. to 2000° F., 1090° C.) to decrease sulfur, remove heteroatoms and upgrade a feed, and therefore, teaches away from the expectation that low temperature low pressure hydrogen treatments would be successful.

Methods also exist for the regeneration of aqueous alkali metal. See, e.g., U.S. Pat. No. 4,163,043 discussing regeneration of aqueous solutions of Na, K and/or ammonium sulfide by contact with Cu oxide powder yielding precipitated sulfide which is separated and re-oxidized to copper oxide at elevated temperatures and an aqueous solution enriched in NaOH, KOH or $NH_3$. Romanian patent RO-101296-A describes residual sodium sulfide removal wherein the sulfides are recovered by washing first with mineral acids (e.g., hydrochloric acid or sulfuric acid) and then with sodium hydroxide or carbonate to form sodium sulfide followed by a final purification using iron turnings to give insoluble ferrous sulfide.

The costs for handling such feeds can be high. Hence, reducing viscosity, heteroatom and naphthenic acid content have become critical targets. Thus, there is a need for low-cost processes which upgrade oils to reduce the dependence on diluent addition and to produce more profitable feedstocks.

SUMMARY OF THE INVENTION

The instant invention is directed toward a process for the reduction of viscosity and naphthenic acid content in heavy oils and minimization of heavy ends production in the substantial absence of coke formation. The process also increases API gravity and decreases levels of heteroatoms such as nitrogen and sulfur. The process involves contacting a heavy oil with a solid Group IIA hydroxide and using low pressure hydrogen to form the corresponding Group IIA sulfide and a treated heavy oil having decreased sulfur and nitrogen content, viscosity (e.g., typically from 20,000 to greater than 100,000 cP to less than 1,000 cP, and naphthenic acid concentrations, e.g., typically from 2 to 5 meq KOH as measured by titration to less than 0.5 meq KOH). Low pressure hydrogen is typically from zero up to 214 psi (1,500 kPa). Reactive sulfur in the form of aliphatic sulfur, e.g., typically is decreased from 0.6–0.7 wt % to $\leqq$0.25 wt %. Higher API gravity (e.g., typically from less than or equal to 7 to $10^+$ API) also results. Due to the presence of lime, $H_2S$ and $CO_2$ byproducts (which are generated as intermediate byproducts via thermal decomposition and can otherwise be corrosive to reactors) are essentially absent. The heavy oil is recovered and the Group IIA sulfide solid byproduct is removed and can be either regenerated for a continuous in-situ process or converted to a more environmentally friendly byproduct for disposal or sale. Optionally, the process can recycle the Group IIA sulfide and excess Group IIA hydroxide byproduct to the initial reactor for reuse until the hydroxide is depleted or reduced to ineffective levels.

Regeneration of the desulfurization agent can be accomplished by mild steam stripping of CaS directly which would generate $H_2S$ (which, e.g., can be treated in a Claus Plant). The Group IIA sulfide formed (a) could alternatively be treated with $H_2S$ and then followed by steam stripping or (b) with $CO_2$ and $H_2O$ to form Group IIA carbonate followed by calcining and water quenching. Alternatively, the Group IIA sulfide can be oxidized to the Group IIA sulfate (e.g., $CaSO_4$ or gypsum for calcium) which can be sold or disposed of.

The Group IIA metals include calcium and magnesium metal although calcium is preferred. As used herein, contacting includes reacting.

The present invention may comprise, consist or consist essentially of the elements disclosed herein and may be practiced in the absence of a step not specifically disclosed.

DETAILED DESCRIPTION OF THE INVENTION

Applicants have found that heating heavy oil in the presence of solid (i.e., anhydrous, non-molten) Group IIA hydroxides, preferably calcium hydroxide (thereby forming a solid-liquid system) and low pressure hydrogen are capable of decreasing the viscosity, corrosivity and heteroatom content of heavy oil, increasing the API gravity in the absence of coke and heavy ends formation. "Heavy oils" as used herein includes vacuum resids, atmospheric resids, heavy crudes where greater than 50% of the components of such crudes boil at 1050° F. (552° C.) and higher, and high sulfur crudes containing greater than 0.5% of sulfur.

The addition of at least one solid Group IIA hydroxide allows for the initial product from the desulfurization step, i.e., the corresponding alkaline earth sulfide to further react in one of several ways to regenerate the alkaline earth hydroxide or conversion to the corresponding Group IIA sulfate as a solid byproduct.

The concentration of solid Group IIA hydroxide added to the sulfur containing feedstock will range from about 1 wt % to about 30 wt %, preferably about 1 wt % to about 10 wt % based on the weight of the feedstock. Such concentrations provide a mole ratio of about 0.2:1 to about 1:1 alkaline earth metal hydroxide:sulfur. Although a one-time reaction of the hydroxide with the feedstock is sufficient, subsequent treatments of the feedstock with additional solid Group IIA hydroxide can be performed. The byproduct Group IIA sulfide and unreacted Group IIA hydroxide can also be recycled to the primary reaction for further treatments.

The hydroxide and feedstock are reacted at a temperature of about 380° C. to about 450° C., preferably the temperature will be between 390 to 410° C. The reaction times are typically at least about 5 minutes to about three hours, more typically the reaction time will be about 10 minutes to one hour. Within this range temperatures of at least 380° C. are necessary to remove sulfur via thermal means to result in $H_2S$ formation, which is then scrubbed from the system internally to form the Group IIA sulfide. Preferably, reaction temperatures are maintained at or below about 400° C. for treatment times of less than 30 minutes to further prevent excessive cracking reactions that can lead to coke formation from occurring.

Molecular hydrogen optionally added to the hydroxide system for contacting with the starting heavy oil aids in capping off radicals formed during heating and in forming the initial $H_2S$ product. The pressure of the hydrogen added will be low, typically zero up to 214 psi (1,500 kPa); typically when added can be from about 50 psi (345 kPa) to about 214 psi (1,500 kPa), preferably about 100 psi (690 kPa) to about 200 psi (1,300 kPa) (cold charge) of the initial feed charge.

The present invention not only removes organically bound sulfur from the feedstocks but advantageously also removes nitrogen. The invention is capable of removing 10 percent or more of such organically bound sulfur from the sulfur containing feedstock. Unexpectedly, significant conversion of these heavy oils to lighter materials is evidenced by observed reductions in density, viscosity and 1025° F.+resid fractions with only slight increases in microcarbon residue ("MCR") content and essentially no coke formation. Additionally, the treatment produces a decreased naphthenic acid content (TAN) in the treated feed product. By contrast, treatments using Group IIA hydroxide with water present result in higher operating pressures, less sulfur removal and more viscous oil products.

Once the treatment of the crude oil has been concluded (whether as a batch or recycled process), the alkaline earth metal sulfide generated can be treated in a number of different steps. Using Ca as an example, the alkaline earth metal sulfide may react as follows:

$$CaS \xrightarrow{2H_2O} Ca(OH)_2 + H_2S \quad \text{or,}$$

$$CaS \xrightarrow{+H_2S} Ca(HS)_2 \xrightarrow{\text{steam}} Ca(OH)_2 + H_2S \quad \text{or,}$$

$$CaS \xrightarrow{+H_2S} Ca(HS)_2 \xrightarrow{4/5\ O_2} 2/5\ CaS_5 + 3/5\ Ca(OH)_2 \quad \text{or,}$$

-continued $$CaS \xrightarrow{CO_2 + H_2O} CaCO_3 + H_2S \xrightarrow[-H_2S]{+\text{heat}}$$

$$CaO + CO_2 \xrightarrow[-CO_2]{+H_2O} Ca(OH)_2$$

In each instance the process is carried out as a continuous process in which the treated, reduced sulfur content oil is withdrawn and the solid alkaline earth hydroxide is converted into the corresponding sulfide which is further treated to regenerate the alkaline earth hydroxide for recycle to treat additional starting crude.

If a steam stripping step is chosen to regenerate the alkaline earth metal hydroxide, the reaction can be carried out at temperatures of about 150° C. to about 300° C., for reaction times sufficient to remove the hydrogen sulfide. Reaction times are easily determined by one skilled in the art. The other two are carried out at atmospheric pressures and ambient temperature.

As an alternative to regeneration, the produced Group IIA sulfide from the process can also be oxidized under ambient temperatures and pressures to form the corresponding Group IIA sulfate which can be disposed of or sold.

The following examples are for illustration and are not meant to be limiting.

EXAMPLES

The following examples illustrate the effectiveness of solid Group IIA hydroxide (calcium hydroxide is used as an example) systems to upgrade the heavy oils by reducing viscosity, TAN, heteroatoms (sulfur and nitrogen), resid while increasing API gravity. The experimental conditions include a temperature range of about 400° C. for 23 minutes using of 0.5:1 molar ratio of $Ca(OH)_2$ to sulfur in oil. In the comparison using water a 1:18 w/w charge of water to oil was used. 200 psig (1,380 kPa) hydrogen cold charge also was used.

Example 1

An extra heavy oil (greater than 50% 1,050° F. fraction) was subjected to autoclave treatment using slaked lime as the base with and without the presence of water. The results in Table 1, Exp. ID96X (with water) and 96AD (without water) illustrate that the presence of water during these treatments is less effective in reducing the viscosity of the oil and the sulfur content while yet requiring higher pressure operations.

TABLE 1

Upgrading Treatments of Heavy Oil with Lime[a]

| Exp. ID | | 96X | 96AA | 96AD | 97A |
|---|---|---|---|---|---|
| Ca(OH)2:S (molar) | | 0.5:1 | 0.:1 | 0.5:1 | 0.2:1 |
| Water:oil (w/w) | | 1:18 | 1:18 | none | none |
| $H_2$ charge (kPa) | | 1,400 | none | 1,394 | 1,400 |
| Operating Pressure (kPa) | | 5,865 | 752 | 4,140 | 4,043 |
| Properties | Initial | | | | |
| Wt % Nitrogen | 0.73 | 0.60 | 0.52 | 0.67 | 0.61 |
| Wt % Sulfur | 3.60 | 3.21 | 3.11 | 2.99 | 3.12 |
| S/C ratio | 0.0160 | 0.0147 | 0.0141 | 0.0137 | 0.0143 |
| % S Removal | — | 8.1 | 11.9 | 14.4 | 10.6 |
| Wt % MCR | 14.9 | 15.8 | 16.6 | 15.6 | 15.7 |

TABLE 1-continued

Upgrading Treatments of Heavy Oil with Lime[a]

| Exp. ID | | 96X | 96AA | 96AD | 97A |
|---|---|---|---|---|---|
| % increase in MCR | — | 6.0 | 11.4 | 4.7 | 5.4 |
| Wt % 552° C. + fraction | 52.7 | 42.8 | 42.1 | —[b] | —[b] |
| % Conversion | — | 18.8 | 20.1 | —[b] | —[b] |
| Viscosity, cP | 21,700 | 742 | 1,610 | 594 | 574 |
| API | 9.7 | 14–15 | 13–14 | 14–15 | 14–15 |
| Corrosive Materials | | | | | |
| % Reactive S | 0.650 | 0.170 | 0.256 | —[b] | —[b] |
| TAN | 1.9 | 0.52 | 0.64 | —[b] | —[b] |

[a]Treatments conducted in an autoclave at 400° C. for 23 minutes.
[b]Tests not conducted for these specific samples. However, given the decreases in these due to thermal effects, no changes in the results should be expected due to the presence of water.

What is claimed is:

1. A continuous in-situ process for decreasing the viscosity and corrosivity of heavy oils and increasing its API gravity and decreasing heteroatom content), comprising:

(a) contacting a heavy oil with at least one solid alkaline earth metal hydroxide at a temperature of about 380° C. to about 450° C. at a low molecular hydrogen pressure for a time sufficient to form the corresponding alkaline earth metal sulfide and a treated heavy oil having a decreased heteroatom content corrosivity and a viscosity of less than 1000 cPs having a substantial absence of coke formation;

(b) recovering the treated heavy oil;

(c) regenerating the solid alkaline earth metal hydroxide;

(d) recirculating the regenerated alkaline earth metal hydroxide from step (c) to step (a).

2. The method of claim 1 wherein the pressure of hydrogen is from zero to about 1,500 kPa.

3. The method of claim 1 wherein the alkaline earth metal sulfide is converted to alkaline earth metal sulfate.

4. The method of claim 1 wherein step (b) is conducted at a temperature of about 380° C. to about 425° C. and for about 0.2 to about 2 hours.

5. The method of claim 1 wherein the regeneration of step (c) is accomplished by steam stripping the alkaline earth metal sulfide.

6. The method of claim 1 wherein step (c) is carried out by reacting the alkaline earth metal sulfide with $H_2S$ to form alkaline earth metal hydrosulfide and oxidizing the alkaline earth metal hydrosulfide to form the corresponding alkaline earth metal hydroxide, water and alkaline earth metal pentasulfide.

7. The method of claim 1 wherein step (c) is carried out by reacting the alkaline earth metal sulfide with $CO_2$ and water to form the corresponding alkaline earth metal carbonate and $H_2S$, removing the $H_2S$, heating the alkaline earth metal carbonate at greater than 800° C. to form the corresponding alkaline earth metal oxide and $CO_2$, and quenching the alkaline earth metal oxide with water to form the corresponding alkaline earth metal hydroxide.

8. The method of claim 1 wherein the alkaline earth metal is Ca.

9. The method of claim 1 wherein the pressure of hydrogen is from 345 kPa to about 1,500 kPa.

* * * * *